US008716954B2

(12) United States Patent
Takahashi et al.

(10) Patent No.: US 8,716,954 B2
(45) Date of Patent: May 6, 2014

(54) LED DRIVE CIRCUIT

(75) Inventors: Kazuhiro Takahashi, Niiza (JP); Naoharu Furukawa, Nizza (JP); Hiroshi Domon, Niiza (JP)

(73) Assignee: Sanken Electric Co., Ltd., Niiza-shi (JP)

( * ) Notice: Subject to any disclaimer, the term of this patent is extended or adjusted under 35 U.S.C. 154(b) by 87 days.

(21) Appl. No.: 13/391,037

(22) PCT Filed: Aug. 17, 2010

(86) PCT No.: PCT/JP2010/063867

§ 371 (c)(1), (2), (4) Date: Feb. 17, 2012

(87) PCT Pub. No.: WO2011/021624

PCT Pub. Date: Feb. 24, 2011

(65) Prior Publication Data

US 2012/0146550 A1 Jun. 14, 2012

(30) Foreign Application Priority Data

Aug. 18, 2009 (JP) ..... 2009-189147

(51) Int. Cl.
*H05B 37/02* (2006.01)

(52) U.S. Cl.
USPC ..... 315/307; 315/209 R; 315/308

(58) Field of Classification Search
USPC ..... 315/209 R, 224, 225, 226, 291, 307, 308
See application file for complete search history.

(56) References Cited

U.S. PATENT DOCUMENTS

| | | | | |
|---|---|---|---|---|
| 8,456,106 | B2 * | 6/2013 | Mednik et al. | 315/307 |
| 2004/0080273 | A1 | 4/2004 | Ito et al. | |
| 2006/0022837 | A1 | 2/2006 | Takahashi et al. | |
| 2009/0302774 | A1 * | 12/2009 | Mednik et al. | 315/209 R |
| 2010/0109537 | A1 | 5/2010 | Nishino et al. | |
| 2010/0207543 | A1 * | 8/2010 | Crawford et al. | 315/294 |
| 2013/0181631 | A1 * | 7/2013 | Omi, Masaki | 315/224 |

FOREIGN PATENT DOCUMENTS

| | | |
|---|---|---|
| JP | 2003-272885 | 9/2003 |
| JP | 2004 134147 | 4/2004 |
| JP | 2005 295630 | 10/2005 |
| JP | 2006 319221 | 11/2006 |

(Continued)

OTHER PUBLICATIONS

International Search Report Issued Sep. 21, 2010 in PCT/JP10/63867 Filed Aug. 17, 2010.

(Continued)

*Primary Examiner* — Tung X Le
(74) *Attorney, Agent, or Firm* — Oblon, Spivak, McClelland, Maier & Neustadt, L.L.P.

(57) ABSTRACT

An LED drive circuit for driving an LED includes a reactor L1, a switch element, a current detection resistor R1 to detect a current of the switch element, a constant current circuit 2 that generates a first control signal to control a current of the switch element to be constant, a disconnection detection circuit 4*a* that generates a second control signal to keep the switch element OFF if determining that a current equal to or over a predetermined value passes through the switch element when a predetermined time elapses after the timing at which the switch element changes its state from ON to OFF, and a driver of the switch element that drives the switch element and keeps the switch element OFF in case of a disconnection according to the second control signal in priority to the first control signal.

3 Claims, 13 Drawing Sheets

(56) References Cited

FOREIGN PATENT DOCUMENTS

| | | |
|---|---|---|
| JP | 2007-59635 | 3/2007 |
| JP | 2007 182158 | 7/2007 |
| JP | 2008 130296 | 6/2008 |
| JP | 2008 186668 | 8/2008 |

OTHER PUBLICATIONS

Office Action issued Aug. 16, 2013 in Korean Patent Application No. 10-2012-7006136.
Office Action issued Dec. 31, 2013 in Chinese Patent Application No. 201080036456.3.

* cited by examiner

LED DRIVE CIRCUIT

TECHNICAL FIELD

The present invention relates to an LED drive circuit for driving an LED (light emitting diode).

BACKGROUND TECHNOLOGY

In recent years, the development and practical application of LED drive circuits for driving LEDs are advancing. An example thereof is LED illumination employing PWM constant current control. FIG. 1 is a circuit diagram illustrating the configuration of an LED drive circuit according to a related art. The LED drive circuit includes, as illustrated in FIG. 1, a regenerative diode D1, a reactor L1, and a driver IC 1 to drive an LED 10. The driver IC 1 incorporates a switch element Q1 such as an FET, a drive circuit 3 of the switch element Q1, and a constant current circuit 2. The driver IC 1 is connected to an external current detection resistor R1 that is connected in series with the switch element Q1. The current detection resistor R1 may be incorporated in the driver IC 1. The constant current circuit 2 has a comparator 21 and a control circuit 22, to prevent a current equal to or over a given value from passing to the switch element Q1.

The comparator 21 compares a reference voltage Vref inputted to an inverting terminal (depicted by "−") with a voltage generated by the current detection resistor R1 and inputted to a non-inverting terminal (depicted by "+") and outputs a comparison result to the control circuit 22. The current detection resistor R1 is connected in series with the switch element Q1, generates, at both ends thereof, a voltage corresponding to a current passing to the switch element Q1, and applies the voltage to the non-inverting terminal (+) of the comparator 21. According to the comparison result of the comparator 21, the controller 22 outputs a signal to adjust an ON duty ratio of the switch element Q.

According to the output signal from the control circuit 22 in the constant current circuit 2, the drive circuit 3 of the switch element Q1 applies a voltage to a gate of the switch element Q1, thereby turning on/off the switch element Q1.

Operation of the LED drive circuit according to the related art is explained. FIG. 2 is a view explaining operation of the LED drive circuit according to the related art. FIG. 3 is a view illustrating operating waveforms at various parts of the LED drive circuit according to the related art. In FIG. 2, the constant current circuit 2 and drive circuit 3 of the switch element Q1 are not illustrated but they are actually present.

First, the switch element Q1 turns on at time t0 of FIG. 3 when a predetermined gate voltage Vg is applied from the drive circuit 3 of the switch element Q1. At this time, an ON current (load current) passes as illustrated in FIG. 2 through a path extending along a power source through the reactor L1, switch element Q1, and current detection resistor R1 to the ground, thereby accumulating counter electromotive force in the reactor L1.

Between time t0 and t1 of FIG. 3, the ON current increases at a predetermined inclination ($di=L1\times dV/dt$) according to a constant of the reactor L1. The ON current passes through the current detection resistor R1, and therefore, a voltage Vrs generated by the current detection resistor R1 also increases.

At time t1, the voltage Vrs generated by the current detection resistor R1 exceeds the reference voltage Vref, and therefore, an output from the comparator 21 inverts. Then, the control circuit 22 outputs a signal to turn off the switch element Q1. According to the output signal from the control circuit 22, the drive circuit 3 of the switch element Q1 decreases the gate voltage of the switch element Q1, to turn off the switch element Q1.

As a result, energy of the counter electromotive force accumulated in the reactor L1 passes as a regenerative current through a loop extending along the reactor L1, LED 10, and diode D1 and is thereby consumed. Accordingly, no current passes through the current detection resistor R1, and therefore, the voltage Vrs across the current detection resistor R1 becomes zero.

After the elapse of a predetermined time, the control circuit 22 outputs at time t2 a signal to turn on the switch element Q1. Namely, the LED drive circuit according to the related art explained here is a circuit that carries out an OFF time fixed operation. According to the output signal from the control circuit 22, the drive circuit 3 of the switch element Q1 increases the gate voltage of the switch element Q1, to turn on the switch element Q1.

The LED drive circuit according to the related art illustrated in FIG. 1 repeats the above-mentioned operation, to supply a proper current to the LED 10 and drive the same.

Japanese Unexamined Patent Application Publication No. 2006-319221 (Patent Document 1) describes an LED drive circuit that is realizable with a simple structure and passes an equal current to a plurality of parallel LED circuits. This LED drive circuit includes a current source that generates a temporally changing current and first and second smoothing capacitors. The LED drive circuit drives a first LED circuit that is arranged in parallel with the first smoothing capacitor and has one or a plurality of LEDs connected in series and a second LED circuit that is arranged in parallel with the second smoothing capacitor and has one or a plurality of LEDs connected in series. Further, the LED drive circuit includes a current dividing coil that has two coils connected to each other through a tap to which the current generated by the current source is passed, a first reverse current protection diode connected between a first end of the current dividing coil and a first electrode of the first smoothing capacitor, and a second reverse current protection diode connected between a second end of the current dividing coil and a first electrode of the second smoothing capacitor.

According to this LED drive circuit, the temporally changing current generated by the current source passes through the current dividing coil. At this time, the current dividing coil causes an electromagnetic coupling action to divide the current of the current source into currents according to an inverse ratio of two numbers of turns without regard to forward current-forward voltage characteristics of the first and second LED circuits. The divided currents are passed through the respective reverse current protection diodes to the parallel smoothing capacitors and LED circuits. With this, required currents (for example, equal currents) pass through the respective LED circuits even if the LED circuits have different forward current-forward voltage characteristics. This solves problems such as an uneven light quantity (brightness) between the LED circuits, a temperature increase due to different current values, and a difference between service lives and provides high-quality products of simple structure. This also reduces manufacturing costs.

SUMMARY OF INVENTION

A disconnection occurring when an element such as the regenerative diode D1 or the LED 10 breaks down, or a physical removal of wiring may destroy the switch element Q1. FIG. 4 is a view explaining operation of the LED drive circuit according to the related art when a disconnection occurs. FIG. 5 is a view illustrating operating waveforms at various parts of the LED drive circuit according to the related art when a disconnection occurs. In FIG. 4, the constant current circuit 2 and drive circuit 3 of the switch element Q1 are not illustrated but they are actually present, like FIG. 2.

First, the switch element Q1 turns on at time t0 of FIG. 5 when a predetermined gate voltage Vg is applied from the drive circuit 3 of the switch element Q1. At this time, an ON current (load current) passes as illustrated in FIG. 4 through a path extending along the power source through the reactor L1, switch element Q1, and current detection resistor R1 to the ground, thereby accumulating counter electromotive force in the reactor L1.

Between time t0 to t1 in FIG. 5, the ON current increases at a predetermined inclination (di=L1×dV/dt) according to a constant of the reactor L1. The ON current passes through the current detection resistor R1, and therefore, a voltage Vrs generated by the current detection resistor R1 also increases.

It is supposed that a disconnection occurs between time t0 and t1. At time t1, the voltage Vrs generated by the current detection resistor R1 exceeds the reference voltage Vref, and therefore, an output from the comparator 21 inverts. Then, the control circuit 22 outputs a signal to turn off the switch element Q1. According to the output signal from the control circuit 22, the drive circuit 3 of the switch element Q1 decreases the gate voltage of the switch element Q1, to turn off the switch element Q1.

However, there is the disconnection. Accordingly, energy of the counter electromotive force accumulated in the reactor L1 is unable to cause a regenerative current to the LED 10 side. The energy of the counter electromotive force accumulated in the reactor L1, therefore, breaks down the switch element Q1 that is OFF and causes a current. As a result, the energy is completely consumed until time t2 of FIG. 5.

A voltage Vdss at the time of breakdown is higher than a drain voltage Vbb of the switch element Q1 at the time of normal operation. Even if the same current passes in the OFF period, energy consumed during the breakdown is larger and the energy is consumed until time t2 of FIG. 5.

Namely, the magnitude of the counter electromotive force and the breakdown voltage Vdss determine the consumed energy and the period between time t1 and t2 optionally changes.

When a predetermined time elapses after time t1 at which the switch element Q1 turns off, the control circuit 22 outputs at time t3 a signal to turn on the switch element Q1. According to the output signal from the control circuit 22, the drive circuit 3 of the switch element Q1 increases the gate voltage of the switch element Q1, to turn on the switch element Q1.

The energy accumulated in the reactor L1 has been consumed, and therefore, the ON current passing through the reactor L1, switch element Q1, and current detection resistor R1 gradually increases from zero. According to this, the voltage Vrs across the current detection resistor R1 gradually increases from zero, to extend a time to exceed the reference voltage Vref. This results in elongating the ON time (from time t3 to t4) of the switch element Q1 longer than that before the occurrence of disconnection.

If the switch element Q1 always breaks down through the period between time t1 and t3, the current starts to pass at a regenerated energy amount.

At time t4, the voltage Vrs generated by the current detection resistor R1 exceeds the reference voltage Vref and the switch element Q1 again turns off. Similar to the case at time t1, energy of the counter electromotive force accumulated in the reactor L1 breaks down the switch element Q1 that is OFF and passes a current. The energy is completely consumed until time t5 of FIG. 5. The above-mentioned operation is repeated and the switch element Q1 is destroyed.

Namely, the switch element Q1 repeats the ON/OFF operation to increase heat of the switch element Q1 and decrease a breakdown tolerance (a margin up to an upper limit of junction temperature of the switch element Q1). When the tolerance decreases below the applied energy (when the junction temperature of the switch element Q1 exceeds the limit temperature), the switch element Q1 is broken.

It is considered that the LED drive circuit described in Patent Document 1 has a possibility of causing the same problem as the above-mentioned problem. The LED drive circuit described in Patent Document 1 equally divides a drive current for the plurality of LED circuits. For this, the LED drive circuit has the current dividing coil connected to the output side of a switching power source circuit serving as the current source. If the current dividing coil or a rectifying diode in front of the current dividing coil causes a failure such as a disconnection, energy accumulated in the coil will have no way to discharge when a switching element in the switching power source circuit turns on. As a result, the energy is consumed by a breakdown operation of the switching element when the switching element turns off, thereby finally destroying the switching element.

Means to Solve the Problems

The present invention provides an LED drive circuit that solves the above-mentioned problems of the related arts and avoids the breakdown of a switch element even if elements such as LEDs break down or cause a disconnection.

To solve the above-mentioned problems, the LED drive circuit according to the present invention for driving an LED comprises a reactor accumulating power energy to supply a current to the LED, a switch element configured to pass a current through the reactor as being ON and to supply energy accumulated in the reactor to the LED as being OFF, a current detector detecting a current passing through the switch element, a constant current circuit configured to generate a first control signal to control a current passing through the switch element to be constant based on a current value detected by the current detector, a disconnection detector configured to generate a second control signal to keep the switch element OFF if determined that a current equal to or over a predetermined value passes through the switch element when a predetermined time elapses after the timing at which the switch element changes its state from ON to OFF, according to a current detected by the current detector and the first control signal generated by the constant current circuit, and a drive circuit of the switch element configured to drive the switch element according to the first control signal generated by the constant current circuit and keeps the switch element OFF in case of a disconnection according to the second control signal generated by the disconnection detector in priority to the first control signal.

MODE OF IMPLEMENTING INVENTION

LED drive circuits according to embodiments of the present invention will be explained in detail with reference to the drawings.

Embodiment 1

Figure 1:
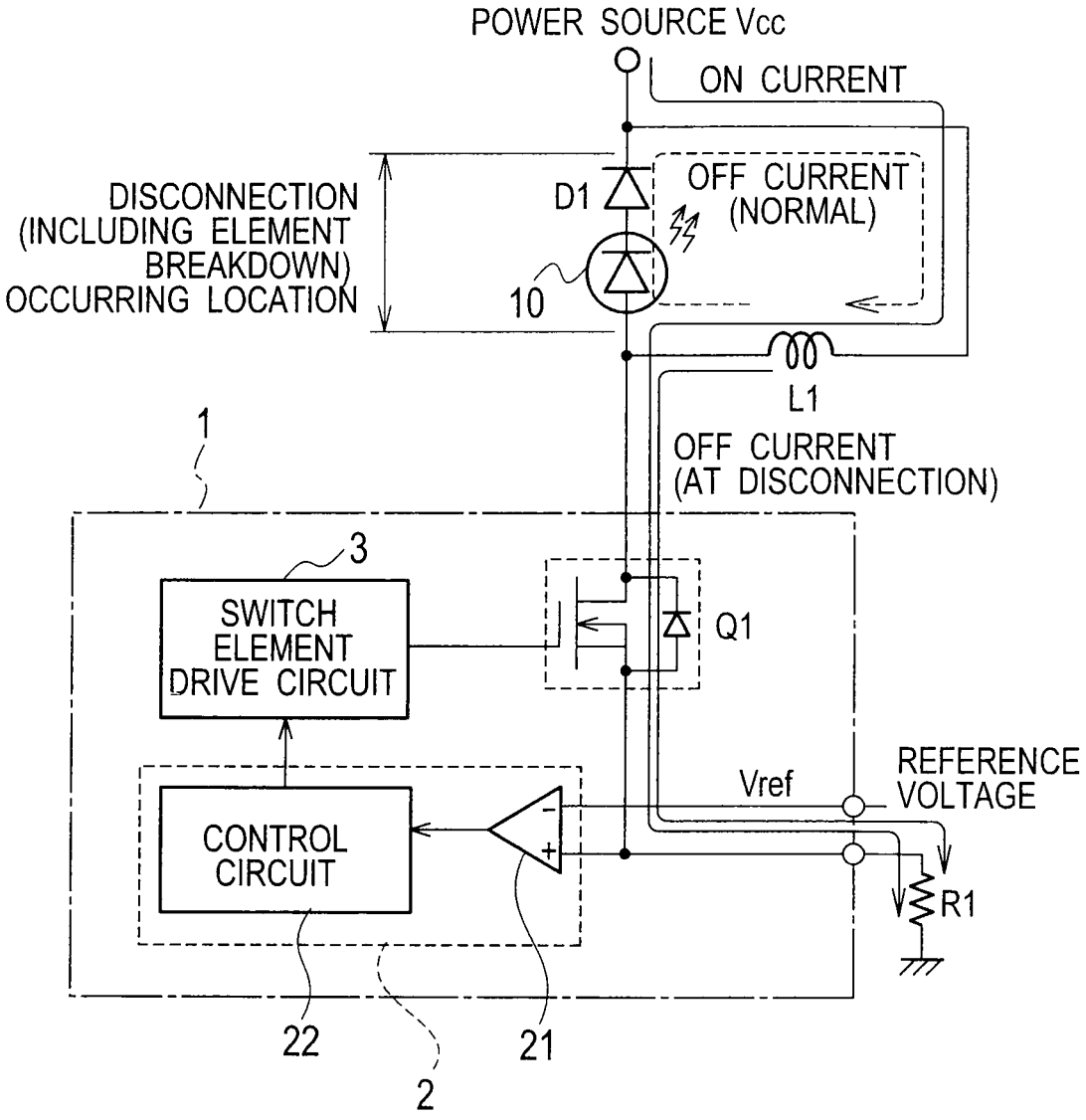
FIG. 1 PRIOR ART
FIG. 1 is a circuit diagram illustrating the configuration of an LED drive circuit according to a related art.
Figure 2:
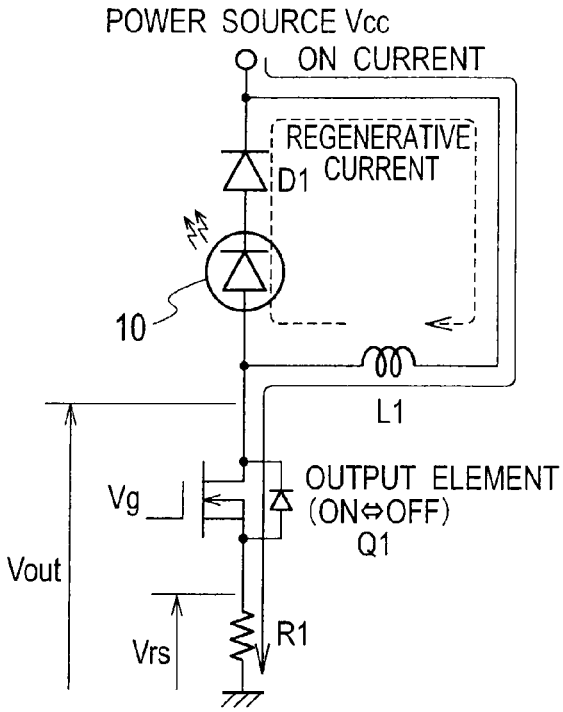
FIG. 2 PRIOR ART
FIG. 2 is a view explaining operation of the LED drive circuit according to the related art.
Figure 6:
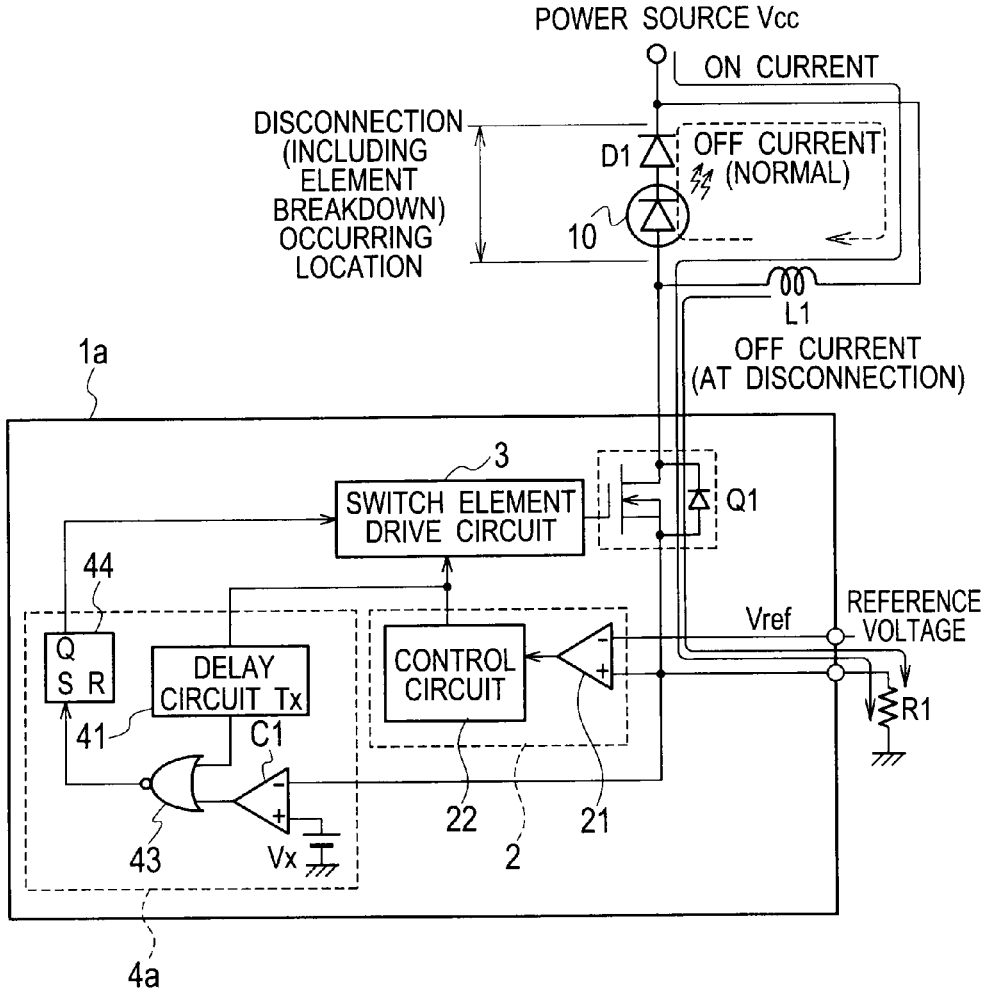
FIG. 6 is a circuit diagram illustrating the configuration of an LED drive circuit according to Embodiment 1 of the present invention.

An embodiment of the present invention will be explained with reference to the drawings. First, the configuration of the embodiment will be explained. FIG. 6 is a circuit diagram illustrating the configuration of an LED drive circuit according to Embodiment 1 of the present invention employing a back boost converter system. This LED drive circuit includes, as illustrated in FIG. 6, a regenerative diode D1, a reactor L1, a current detection resistor R1, and a driver IC 1*a*, to drive an LED 10. The driver IC 1*a* incorporates a switch element Q1 such as an FET, a drive circuit of a switching element 3, a constant current circuit 2, and a disconnection detection circuit 4*a*. Accordingly, what is different from the LED drive circuit of the related art explained with reference to FIG. 1 is that the disconnection detection circuit 4*a* is newly installed. In FIG. 6, the component elements that are the same as or equivalent to those of FIG. 1 are represented with like reference marks to omit overlapping explanation.

The reactor L1 accumulates electric power energy to supply a current to the LED 10. The switch element Q1 if ON passes a current through the reactor L1, and if OFF, makes the energy accumulated in the reactor L1 supplied to the LED 10.

The current detection resistor R1 corresponds to the current detector of the present invention and detects a current passing through the switch element Q1. In more detail, the current detection resistor R1 is connected in series with the switch element Q1 and generates a voltage corresponding to a current of the switch element Q1.

The constant current circuit 2 has a comparator 21 and a control circuit 22. Based on a current value detected by the current detection resistor R1, the control circuit 22 generates a first control signal to control a current passing through the switch element Q1 to a constant value and outputs the first control signal to the drive circuit 3 of the switch element Q1 and disconnection detection circuit 4*a*.

The disconnection detection circuit 4*a* corresponds to the disconnection detector of the present invention and generates a second control signal to keep the switch element Q1 OFF if determining that, according to the current detected by the current detection resistor R1 and the first control signal generated by the constant current circuit 2, a current equal to or over a predetermined value is passing through the switch element Q1 when a predetermined time elapses after the timing at which the switch element Q1 changes its state from ON to OFF.

According to the first control signal generated by the constant current circuit 2, the drive circuit of the switch element 3 applies a voltage to a gate of the switch element Q1, thereby driving the switch element Q1. If a disconnection occurs, the drive circuit 3 keeps the switch element Q1 OFF according to the second control signal generated by the disconnection detection circuit 4*a* in priority to the first control signal.

The disconnection detection circuit 4*a* will be explained in detail. The disconnection detection circuit 4*a* includes a delay circuit 41, a comparator C1, a NOR gate 43, and an SR latch circuit (SR-FF) 44. The delay circuit 41 delays the first control signal generated by the constant current circuit 2 by a predetermined delay Tx and outputs the delayed signal. The comparator C1 compares the voltage generated by the current detection resistor R1 with a predetermined reference voltage Vx and outputs a comparison result.

The NOR gate 43 outputs a high-level signal to a terminal S of the SR latch circuit 44 only when the output from the delay circuit 41 and the output from the comparator C1 each are of low level. In other cases, the NOR gate 43 outputs a low-level signal.

The SR latch circuit 44 corresponds to the latch circuit of the present invention, and if the NOR gate 43 outputs a high-level signal, outputs the second control signal of high level to the drive circuit 3 of the switch element Q1. Upon receiving the second control signal of high level, the drive circuit 3 keeps the switch element Q1 OFF without regard to the state of the first control signal.

Namely, if determining that, according to the output from the delay circuit 41 and the output from the comparator C1, a disconnection has occurred, the SR latch circuit 44 generates a latch signal and outputs it as the second control signal. Whether or not there is a disconnection is determined according to the signal outputted from the NOR gate 43. If the NOR gate 43 outputs a high-level signal, it is understood that, although the switch element Q1 is OFF, a predetermined drain current passes through the switch element Q1. Accordingly, the SR latch circuit 44 determines that a disconnection (such as an element breakdown of the LED 10 or regenerative diode D1) is occurring, generates a latch signal, and outputs the signal as the second control signal.

Figure 7:
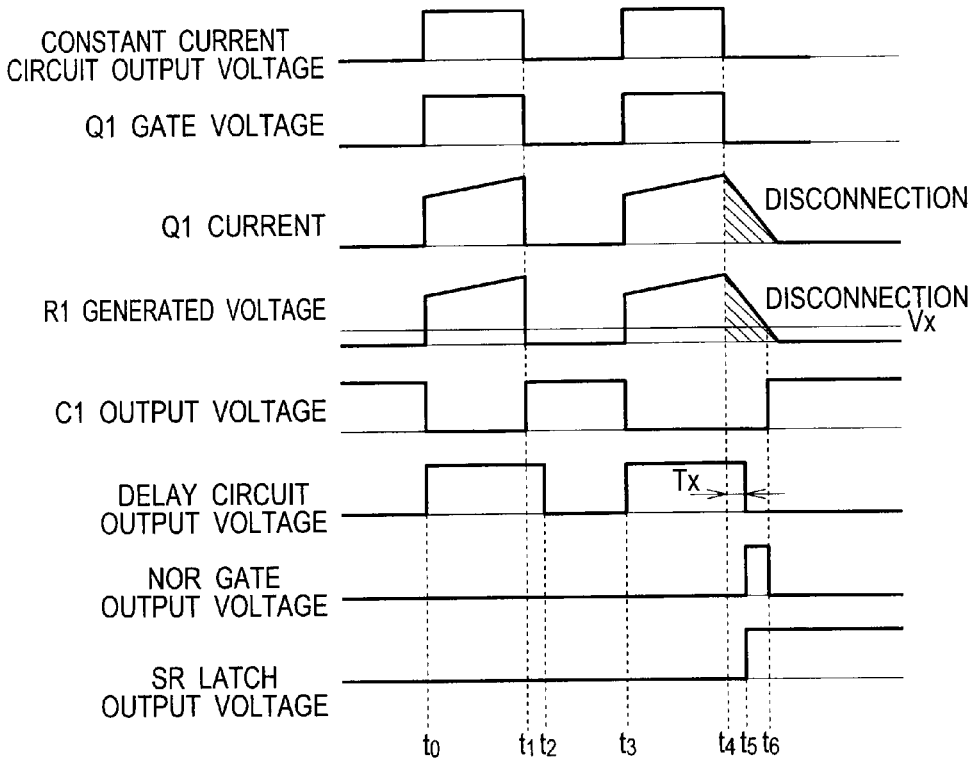
FIG. 7 is a view illustrating operating waveforms at various locations in the LED drive circuit according to Embodiment 1 of the present invention.

Operation of the embodiment with the above-mentioned configuration will be explained. FIG. 7 is a view illustrating operating waveforms at various locations in the LED drive circuit according to the embodiment. First, the switch element Q1 turns on at time t0 of FIG. 7 when the drive circuit 3 of the switch element Q1 applies a predetermined gate voltage. At this time, an ON current (load current) passes through a path extending along the power source, the reactor L1, switch element Q1, and current detection resistor R1 to the ground, thereby accumulating energy of counter electromotive force in the reactor L1.

Between time t0 and t1 of FIG. 7, the ON current (Q1 current, load current) increases at a predetermined inclination (di=L1×dV/dt) according to a constant of the reactor L1. The ON current passes through the current detection resistor R1, and therefore, a voltage (R1 generated voltage) generated by the current detection resistor R1 similarly increases.

At time t1, the voltage (R1 generated voltage) generated by the current detection resistor R1 exceeds a reference voltage Vref, and therefore, an output from the comparator 21 inverts. Then, the control circuit 22 outputs the first control signal to turn off the switch element Q1. This first control signal is the constant current circuit output voltage illustrated in FIG. 7, and at time t1, becomes low to turn off the switch element Q1.

According to the first control signal generated by the constant current circuit 2, the drive circuit 3 drives the switch element Q1. Namely, according to the first control signal (constant current circuit output voltage) from the control circuit 22, the drive circuit 3 of the switch element Q1 decreases the gate voltage of the switch element Q1, thereby turning off the switch element Q1.

With this, the energy of counter electromotive force accumulated in the reactor L1 passes a regenerative current through a path extending along the reactor L1, LED 10, and diode D1 and is thereby consumed. Accordingly, no current passes through the current detection resistor R1 and the voltage (R1 generated voltage) across the current detection resistor R1 becomes zero.

The delay circuit 41 delays the first control signal by the predetermined delay Tx and outputs the delayed signal. As indicated with the delay circuit output voltage in FIG. 7, the delayed signal becomes low at time t2 the predetermined time Tx after time t1 at which the first control signal (constant current circuit output voltage) becomes low. According to the embodiment, the delay circuit 41 is connected to the output side of the control circuit 22, to directly receive the first control signal. This configuration does not limit the present invention. The delay circuit 41 may be connected to the output side of the drive circuit 3 of the switch element Q1. In this case, the delay circuit 41 indirectly receives the first control signal according to an output from the drive circuit 3 of the switch element Q1, delays the same by the predetermined delay Tx, and outputs the delayed signal. This realizes the same operation as the case of connecting the delay circuit 41 to the control circuit 22.

Between time t2 and t3, an output from the delay circuit 41, i.e., delay circuit output voltage is low. At this time, an output (C1 output voltage) from the comparator C1 is high, and therefore, the NOR gate 43 maintains a low-level output.

At time t3 when a predetermined time elapses after time t1, the control circuit 22 outputs the first control signal of high level to turn on the switch element Q1. Based on the first control signal from the control circuit 22, the drive circuit 3 of the switch element Q1 increases the gate voltage of the switch element Q1, thereby turning on the switch element Q1.

Operation between time t3 and t4 is the same as that between time t0 and t1 mentioned above, and therefore, overlapping explanation is omitted. It is supposed that a disconnection occurs between time t3 and t4. The disconnection may be a disconnection of wiring in a regenerative path extending along the LED 10 and regenerative diode D1, or a breakdown of the LED 10 or regenerative diode D1, or the like. Namely, it is a state that the regenerative path is physically and electrically disconnected at the disconnection occurring location as illustrated in FIG. 6 due to some failure.

At time t4, the voltage (R1 generated voltage) generated by the current detection resistor R1 exceeds the reference voltage Vref and the output from the comparator 21 inverts. Then, the control circuit 22 outputs the first control signal to turn off the switch element Q1. Based on the output signal from the control circuit 22, the drive circuit 3 of the switch element Q1 decreases the gate voltage of the switch element Q1, thereby turning off the switch element Q1.

However, there is the disconnection. The energy of the counter electromotive force accumulated in the reactor L1, therefore, is unable to pass as a regenerative current to the LED 10 side. Then, the energy of the counter electromotive force accumulated in the reactor L1 breaks down the switch element Q1 that is OFF and passes a current. Namely, the switch element Q1 breaks down with a withstand voltage specific to the switch element Q1, and with the specific voltage being maintained, a drain current (reactor current) continuously passes. This current also passes through the current detection resistor R1, to cause a positive potential difference at the current detection resistor R1. Accordingly, while the voltage generated by the resistor R1 is being higher than the reference voltage Vx, the comparator C1 maintains the low-level output.

The output voltage of the delay circuit 41 becomes low at time t5 when the predetermined time Tx elapses after time t4 at which the first control signal (constant current circuit output voltage) becomes low. Accordingly, at time t5, the output from the delay circuit 41, i.e., the delay circuit output voltage becomes low. At this time, the output from the comparator C1 (C1 output voltage) is also low. As a result, the NOR gate 43 outputs a high-level pulse signal.

According to the high-level output signal from the NOR gate 43, the SR latch circuit 44 determines that a disconnection has occurred and outputs a high-level latch signal as the second control signal to the drive circuit 3 of the switch element Q1. Based on the second control signal generated by the disconnection detection circuit 4*a*, the drive circuit 3 maintains the switch element Q1 in an OFF state at the time of disconnection in priority to the first control signal. Namely, if receiving the second control signal of high level, the drive circuit 3 keeps the switch element Q1 OFF irrespective of the state of the first control signal.

Figure 8:
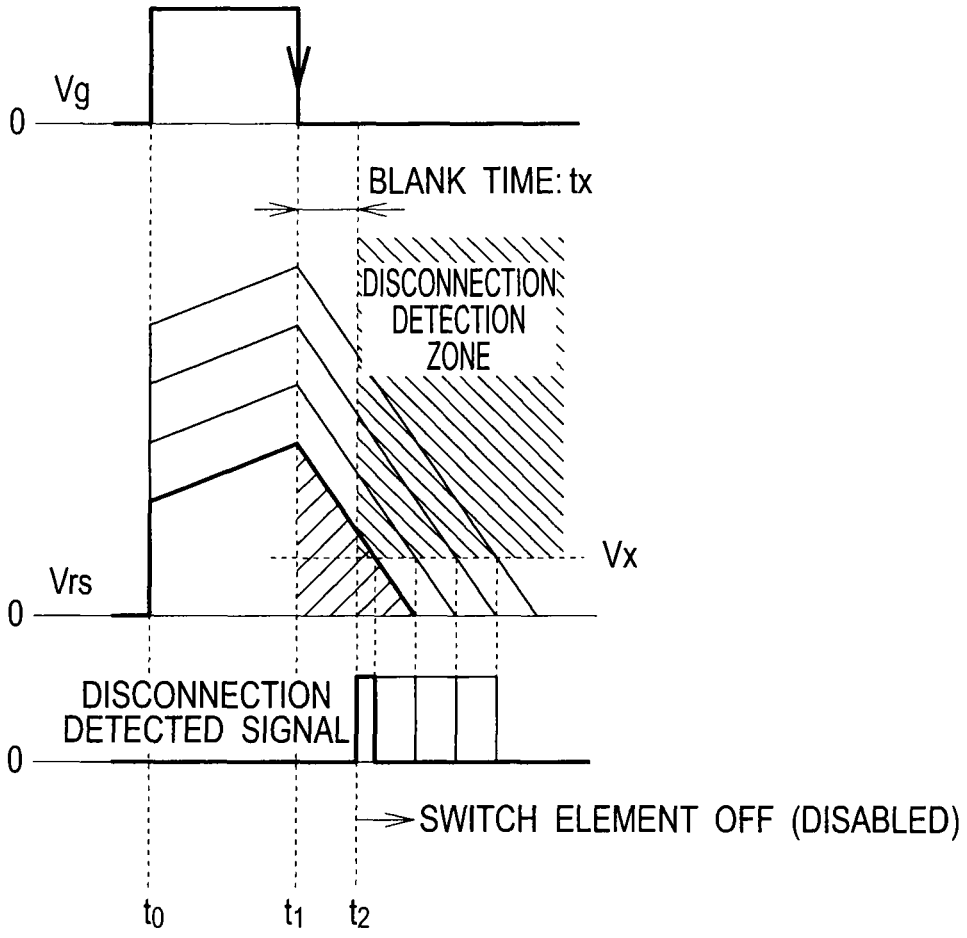
FIG. 8 is a view illustrating a disconnection detection zone of a disconnection detection circuit in the LED drive circuit according to Embodiment 1 of the present invention.

FIG. 8 is a view illustrating a disconnection detection zone of the disconnection detection circuit 4*a* in the LED drive circuit according to the embodiment. In FIG. 8, Vg is a voltage applied to the gate of the switch element Q1 and is the same as the Q1 gate voltage of FIG. 7. The timing at which this Vg becomes low is the same as the timing at which the first control signal (the constant current circuit output voltage of FIG. 7) becomes low.

In FIG. 8, Vrs is the voltage across the current detection resistor R1 and is the same as the R1 generated voltage of FIG. 7. In FIG. 8, disconnection detected signal corresponds to the output from the NOR gate 43 and is the same as the NOR gate output voltage of FIG. 7.

As illustrated in FIGS. 6 to 8, the disconnection detection circuit 4*a* detects a disconnection if the blank time Tx elapses after the timing at which the first control signal generated by the constant current circuit 2 becomes OFF and if the voltage Vrs generated by the current detection resistor R1 is higher than the reference voltage Vx. If these conditions are met, the NOR gate 43 determines that a disconnection has occurred and outputs a disconnection detected signal to the SR latch circuit 44.

The delay time Tx serving as the disconnection detection condition is adjustable by the delay circuit 41 to a value equal to or over zero. As the delay time Tx becomes closer to zero, a detection level increases higher. If chattering is expected, the delay time Tx must be set to an extent not to be influenced by the chattering. If the delay time Tx is set to zero, the delay circuit 41 will not be required.

The reference voltage Vx serving as the disconnection detection condition is adjustable by a voltage inputted to the non-inverting terminal (+) of the comparator C1 to a value equal to or over zero. As the reference voltage Vx becomes closer to zero, a detection level increases higher. If a generation of noise is expected, the reference voltage Vx must be set to an extent not to be influenced by the noise.

At time t5 of FIG. 7, the SR latch circuit 44 outputs a high-level latch signal as the second control signal. Then, as mentioned above, the drive circuit 3 keeps the switch element Q1 OFF irrespective of the state of the first control signal. Accordingly, even if the voltage generated by the current detection resistor R1 at time t6 of FIG. 7 becomes lower than the reference voltage Vx and the NOR gate 43 outputs a low-level signal, the output from the SR latch circuit 44 maintains high level to keep the switch element Q1 OFF.

Unlike the LED drive circuit according to the related art that repeats ON/OFF of the switch element Q1, to consume the accumulated energy of the reactor L1 through a repetition of breakdown operation of the switch element Q1 that is OFF and finally destroy the switch element Q1, the LED drive circuit of the present invention maintains the switch element Q1 in an OFF state after the occurrence of a disconnection, thereby avoiding the above-mentioned breakdown mode.

As mentioned above, the LED drive circuit according to Embodiment 1 of the present invention is capable of avoiding a breakdown of the switch element Q1 even if an element breakdown occurs on the LED 10 or the like or a disconnection occurs. As mentioned above, the switch element Q1 is kept OFF after the detection of a disconnection, and therefore, an event that the temperature of the switch element Q1 increases to decrease a breakdown tolerance is avoidable.

Namely, the LED drive circuit of the present invention detects a potential difference occurring at the current detection resistor R1 that realizes PWM constant current control and instantaneously latches off the switch element Q1, thereby avoiding a breakdown of the switch element Q1 before the tolerance of the switch element Q1 decreases below energy applied thereto.

The disconnection detection circuit 4*a* incorporates the delay circuit 41 and comparator C1, to adjust the blank time Tx and reference voltage Vx that determine a disconnection detection zone. Accordingly, the LED drive circuit of the embodiment is capable of correctly detecting a disconnection without the influence of chattering or noise.

Figure 3:
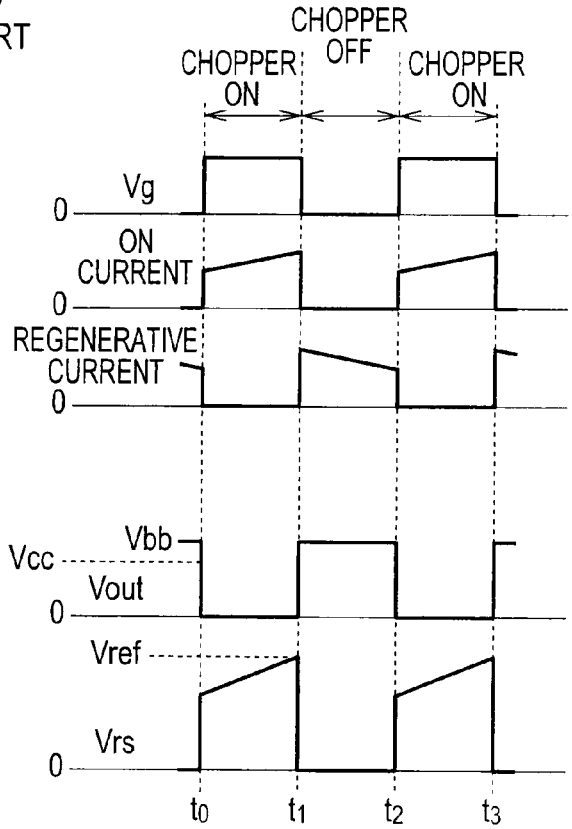
FIG. 3 PRIOR ART
FIG. 3 is a view illustrating operating waveforms at various locations in the LED drive circuit according to the related art.
Figure 4:
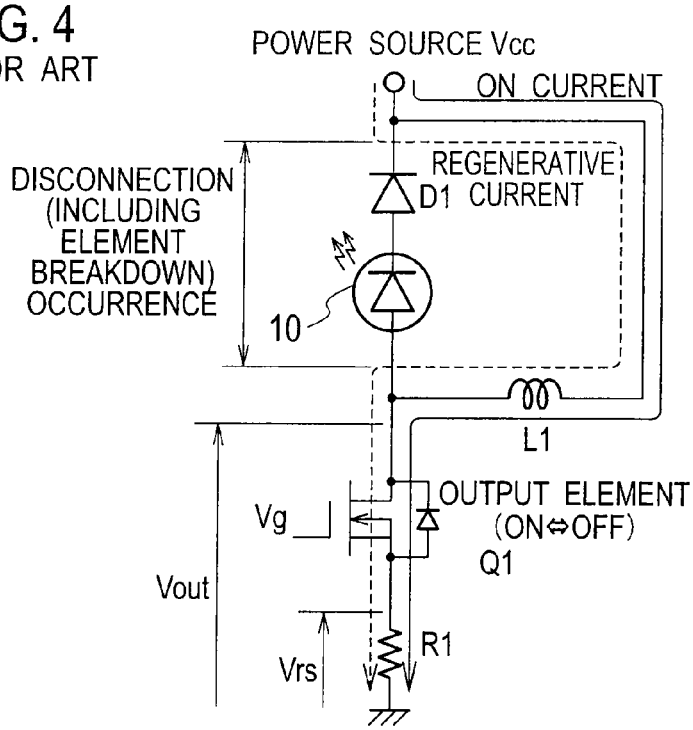
FIG. 4 PRIOR ART
FIG. 4 is a view explaining operation of the LED drive circuit according to the related art when a disconnection occurs.
Figure 9:
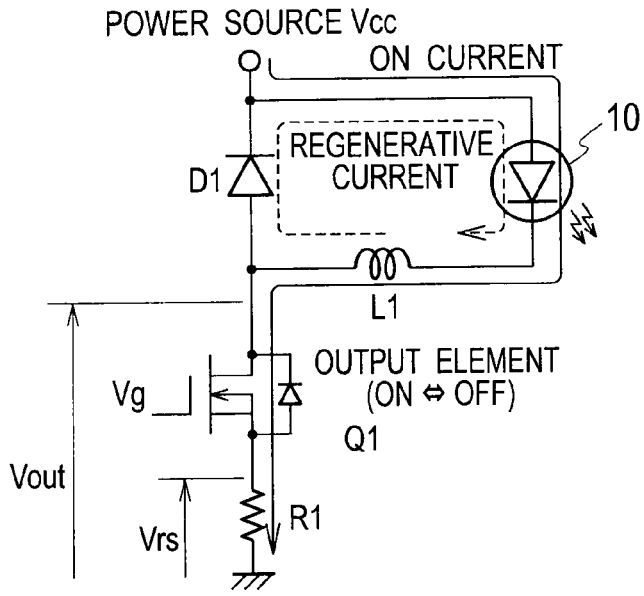
FIG. 9 is a view explaining operation of a different configuration of the LED drive circuit according to Embodiment 1 of the present invention.
Figure 10:
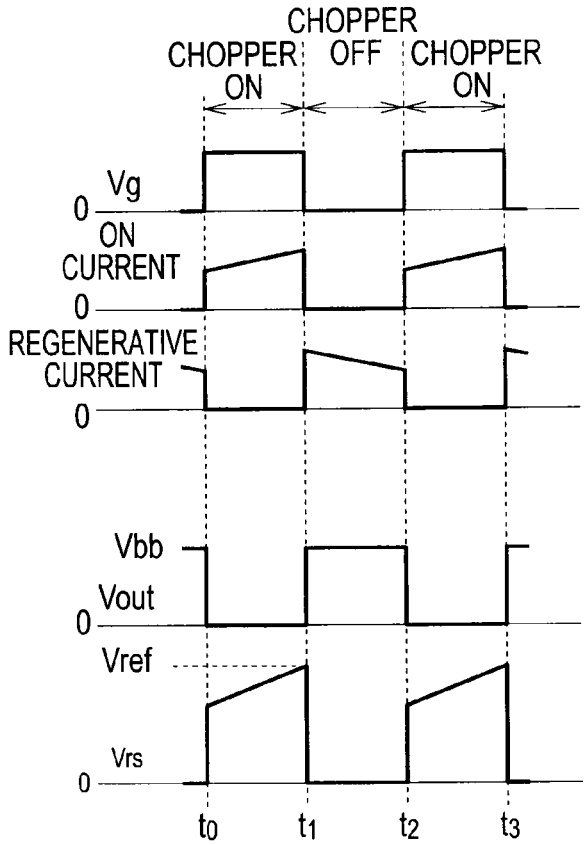
FIG. 10 is a view illustrating operating waveforms at various locations in the different configuration of the LED drive circuit according to Embodiment 1 of the present invention.

FIG. 9 is a view explaining operation of a different configuration of the LED drive circuit according to the embodiment. FIG. 10 is a view illustrating waveforms at various locations in the different configuration of the LED drive circuit according to the embodiment when no disconnection occurs. In FIG. 9, the constant current circuit 2, drive circuit 3 of the switch element Q1, and disconnection detection circuit 4*a* are omitted. What is different from the LED drive circuit illustrated in FIG. 6 is that this different configuration employs a step-down converter system and arranged the LED 10 in an ON current route. Accordingly, the LED drive circuit illustrated in FIG. 9 passes an ON current and an OFF current (regenerative current) both to the LED 10, to drive the same. Operation of the LED drive circuit illustrated in FIG. 9 when no disconnection occurs is the same as that of the LED drive circuit according to the related art explained with reference to FIG. 3, and therefore, overlapping explanation is omitted.

Figure 5:
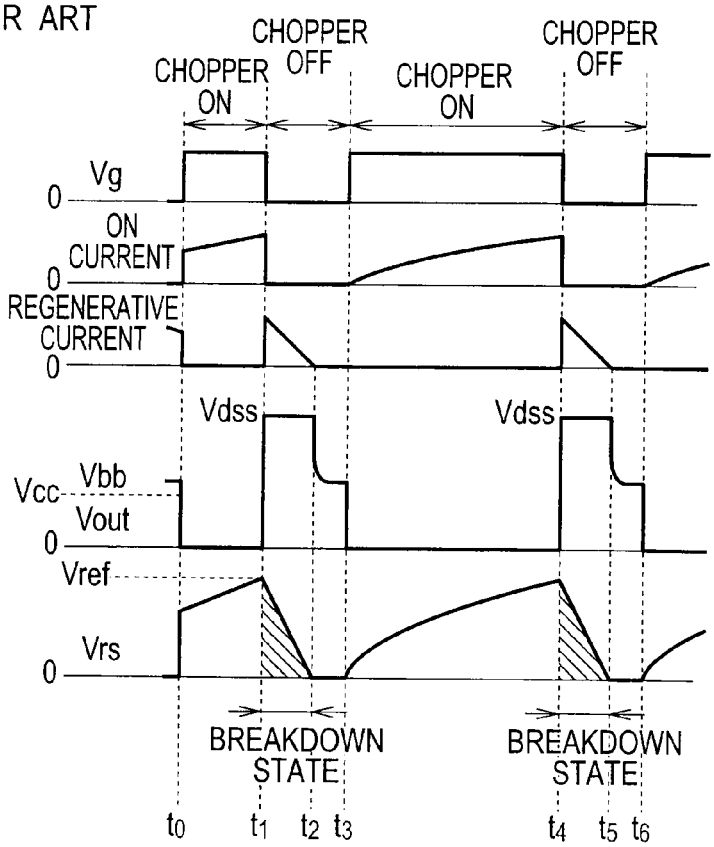
FIG. 5 PRIOR ART
FIG. 5 is a view illustrating operating waveforms at various locations in the LED drive circuit according to the related art when a disconnection occurs.
Figure 11:
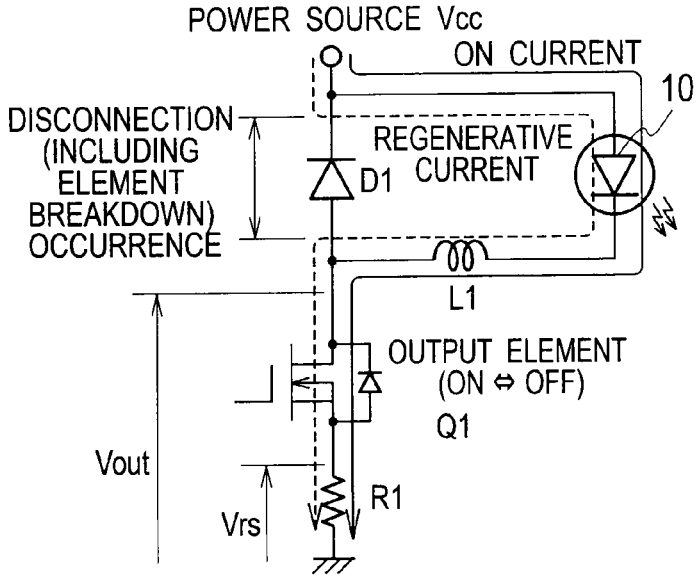
FIG. 11 is a view explaining operation of the different configuration of the LED drive circuit according to Embodiment 1 of the present invention when a disconnection occurs.
Figure 12:
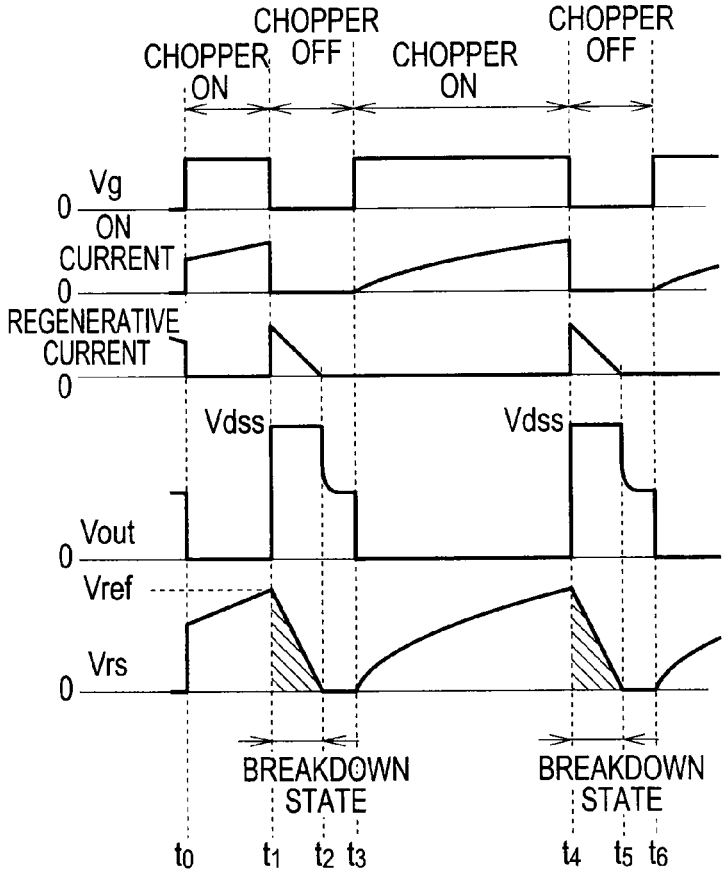
FIG. 12 is a view illustrating operating waveforms at various locations in the different configuration of the LED drive circuit according to Embodiment 1 of the present invention when a disconnection occurs.

FIG. 11 is a view explaining operation of the different configuration of the LED drive circuit according to the embodiment when a disconnection occurs. FIG. 12 is a view illustrating waveforms at various locations in the different configuration of the LED drive circuit according to the embodiment when a disconnection occurs. The waveforms of FIG. 12 are obtained when the disconnection detection circuit 4*a* is not present, and therefore, are the same as those of FIG. 5. If there is the disconnection detection circuit 4*a*, the LED drive circuit according to the embodiment keeps the switch element Q1 OFF after the disconnection is detected, and therefore, the switch element Q1 will not be turned on after time t3 of FIG. 12.

The configurations illustrated in FIGS. 9 and 6 raise a problem when a disconnection occurs at a location where no ON current passes and only a regenerative current passes (for example, a breakdown of the regenerative diode D1). Accordingly, if detecting such a disconnection, the disconnection detection circuit 4*a* generates the second control signal to keep the switch element Q1 OFF. On the other hand, if the LED 10 breaks down, no ON current passes, no energy is accumulated in the reactor L1, and no problem occurs to break down the switch element Q1.

Embodiment 2

Figure 13:
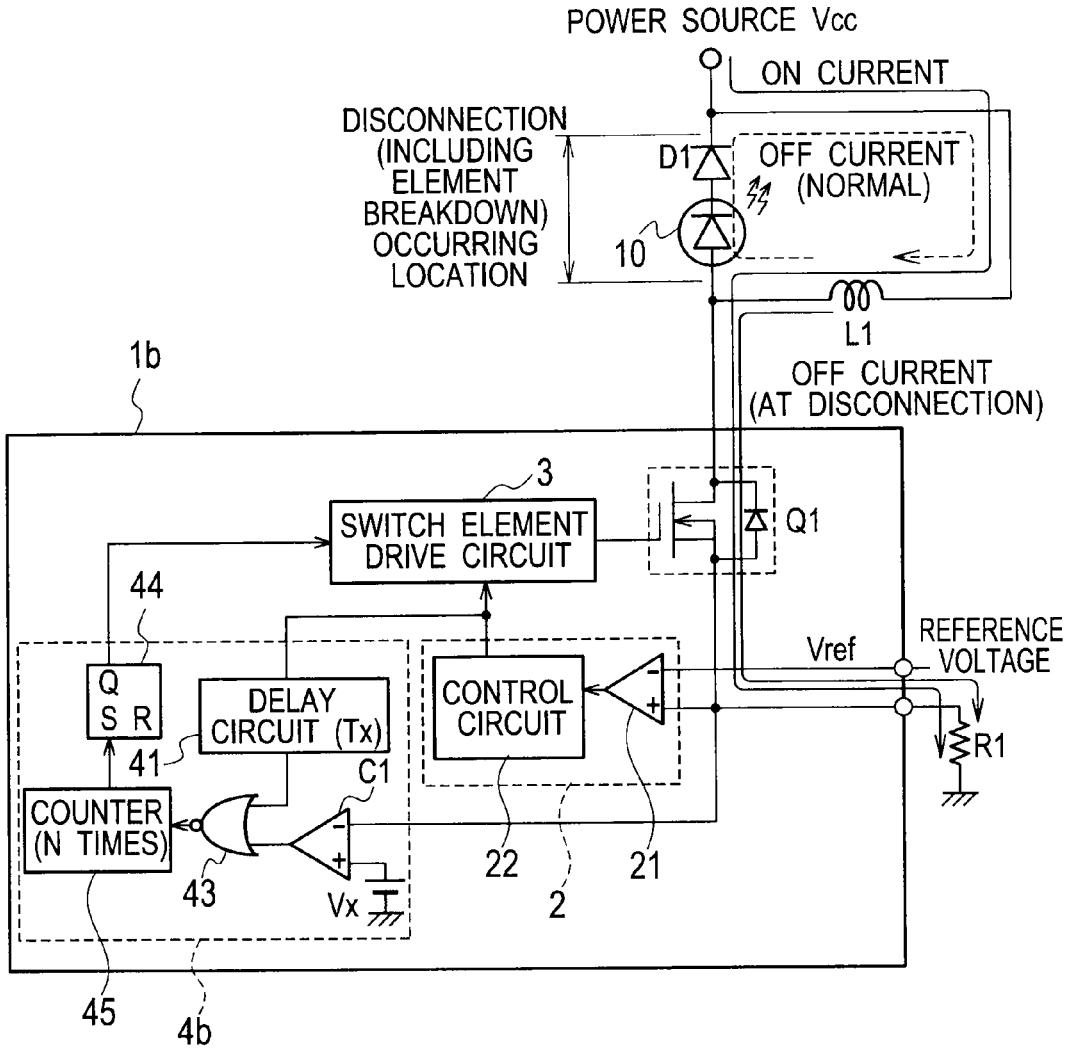
FIG. 13 is a circuit diagram illustrating the configuration of an LED drive circuit according to Embodiment 2 of the present invention.

FIG. 13 is a circuit diagram illustrating the configuration of an LED drive circuit according to Embodiment 2 of the present invention. What is different from the LED drive circuit according to Embodiment 1 illustrated in FIG. 6 is that a counter circuit 45 is newly arranged in a disconnection detection circuit 4*b*.

According to an output from a delay circuit 41 and an output from a comparator C1, the counter circuit 45 counts the number of times of occurrence of a state that a current equal to or over a predetermined value is passing to a switch element Q1 when a predetermined time elapses after the timing at which the switch element Q1 changes its state from ON to OFF. According to the embodiment, the counter circuit 45 outputs one pulse signal if receiving N high-level signals.

If the number of times counted by the counter circuit 45 reaches a predetermined value or over, an SR latch circuit 44 determines that a disconnection has occurred, generates a latch signal, and outputs the signal as a second control signal. In more detail, the SR latch circuit 44 outputs the latch signal if receiving a pulse signal from the counter circuit 45.

The remaining configuration of this LED drive circuit is the same as that of the LED drive circuit according to Embodiment 1 illustrated in FIG. 6, and therefore, overlapping explanation is omitted.

Operation of the embodiment with the above-mentioned configuration will be explained. Operation of the LED drive circuit of this embodiment is the same as that of the LED drive circuit of Embodiment 1 except operation of the counter circuit 45.

Figure 14:
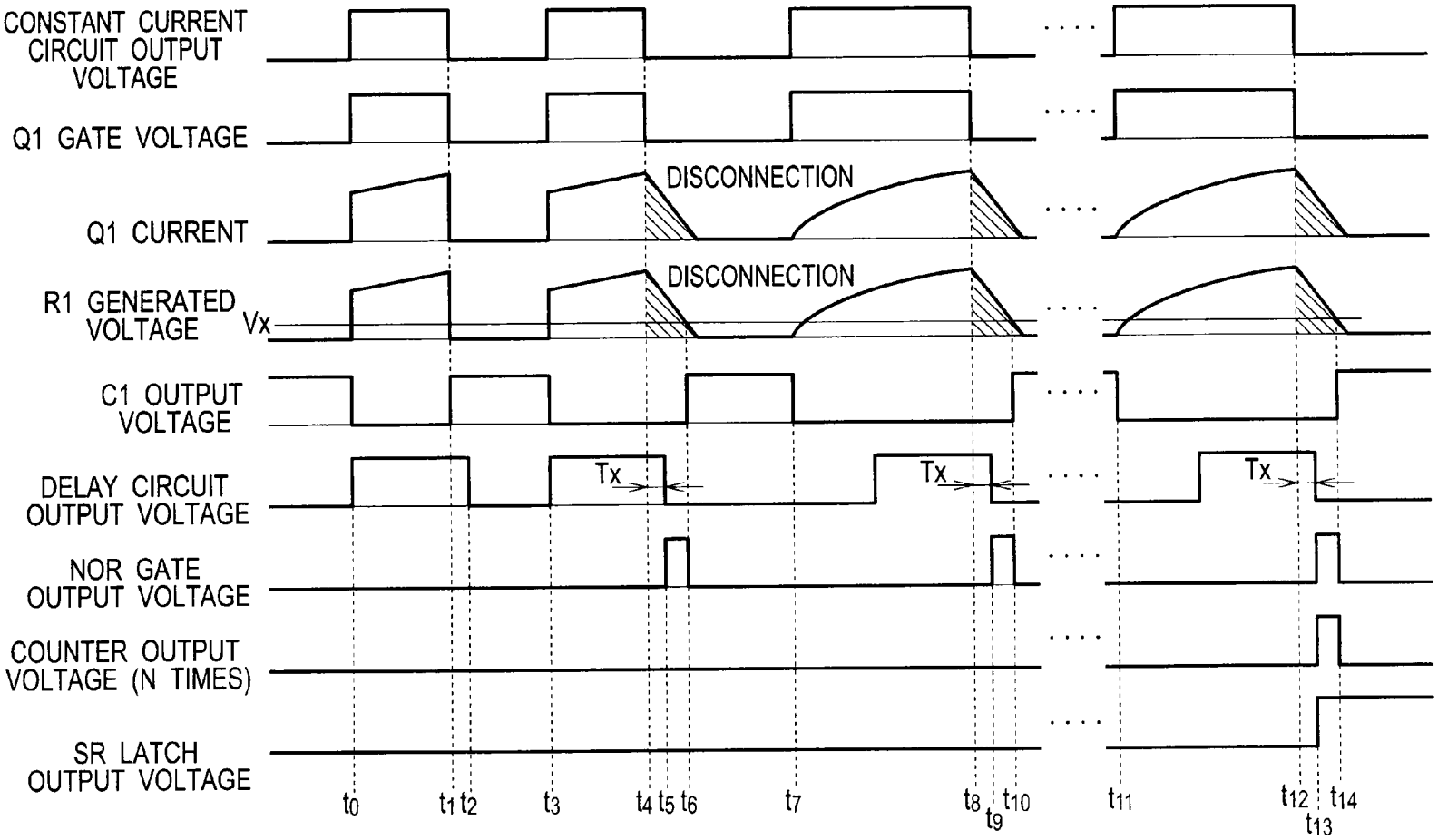
FIG. 14 is a view illustrating operating waveforms at various locations in the LED drive circuit according to Embodiment 2 of the present invention.

FIG. 14 is a view illustrating waveforms at various locations in the LED drive circuit according to the embodiment. First, the switch element Q1 turns on at time t0 of FIG. 14 when a drive circuit 3 of the switch element Q1 applies a predetermined gate voltage. At this time, an ON current (load current) passes through a path extending along a power source, a reactor L1, the switch element Q1, and a current detection resistor R1 to the ground, thereby accumulating energy of counter electromotive force in the reactor L1.

Between time t0 and t1 of FIG. 14, the ON current (Q1 current, load current) increases at a predetermined inclination according to a constant of the reactor L1. The ON current passes to the current detection resistor R1, and therefore, a voltage (R1 generated voltage) generated by the current detection resistor R1 similarly increases.

At time t1, the voltage (R1 generated voltage) generated by the current detection resistor R1 exceeds a reference voltage Vref, and therefore, an output from a comparator 21 inverts. Then, a control circuit 22 outputs a first control signal to turn off the switch element Q1. This first control signal is the constant current circuit output voltage illustrated in FIG. 14, and at time t1, becomes low to turn off the switch element Q1.

According to the first control signal generated by a constant current circuit 2, the drive circuit 3 drives the switch element Q1. Namely, according to the first control signal (constant current circuit output voltage) from the control circuit 22, the drive circuit 3 of the switch element Q1 decreases the gate voltage of the switch element Q1, thereby turning off the switch element Q1.

With this, the energy of counter electromotive force accumulated in the reactor L1 passes a regenerative current through a path extending along the reactor L1, LED 10, and diode D1 and is thereby consumed. Accordingly, no current passes through the current detection resistor R1 and the voltage (R1 generated voltage) across the current detection resistor R1 becomes zero.

The delay circuit 41 delays the first control signal by a predetermined delay Tx and outputs the delayed signal. As indicated with the delay circuit output voltage in FIG. 14, the delayed signal becomes low at time t2 the predetermined time Tx after time t1 at which the first control signal (constant current circuit output voltage) becomes low.

Between time t2 and t3, an output from the delay circuit 41, i.e., delay circuit output voltage is low. At this time, an output (C1 output voltage) from the comparator C1 is high, and therefore, a NOR gate 43 maintains a low-level output.

At time t3 when a predetermined time elapses after time t1, the control circuit 22 outputs the first control signal of high level to turn on the switch element Q1. Based on the first control signal from the control circuit 22, the drive circuit 3 of the switch element Q1 increases the gate voltage of the switch element Q1, thereby turning on the switch element Q1.

Operation between time t3 and t4 is the same as that between time t0 and t1 mentioned above, and therefore, overlapping explanation is omitted. It is supposed that a disconnection occurs between time t3 and t4.

At time t4, the voltage (R1 generated voltage) generated by the current detection resistor R1 exceeds the reference voltage Vref and the output from the comparator 21 inverts. Then, the control circuit 22 outputs the first control signal to turn off the switch element Q1. Based on the output signal from the control circuit 22, the drive circuit 3 of the switch element Q1 decreases the gate voltage of the switch element Q1, thereby turning off the switch element Q1.

However, there is the disconnection. The energy of the counter electromotive force accumulated in the reactor L1, therefore, is unable to pass as a regenerative current to the LED 10 side. Then, the energy of the counter electromotive force accumulated in the reactor L1 breaks down the switch element Q1 that is OFF and passes a current. Namely, the switch element Q1 breaks down with a withstand voltage specific to the switch element Q1, and with the specific voltage being maintained, a drain current (reactor current) continuously passes. This current also passes through the current detection resistor R1, to cause a positive potential difference at the current detection resistor R1. Accordingly, while the voltage generated by the resistor R1 is being higher than a reference voltage Vx, the comparator C1 maintains the low-level output.

The output voltage from the delay circuit 41 becomes low at time t5 when the predetermined time Tx elapses after time t4 at which the first control signal (constant current circuit output voltage) becomes low. Accordingly, at time t5, the output from the delay circuit 41, i.e., delay circuit output voltage becomes low. At this time, the output from the comparator C1 (C1 output voltage) is also low. As a result, the NOR gate 43 outputs a high-level pulse signal.

The counter circuit 45 counts the number of pulse signals from the NOR gate 43. Namely, the counter circuit 45 counts the number of times of occurrence of a state that a current equal to or over a predetermined value is passing to the switch element Q1 when the predetermined time Tx elapses after the timing at which the switch element Q1 changes its state from ON to OFF. At time t5, the counter circuit 45 receives a first pulse signal, and therefore, counts "1".

Thereafter, at time t7, the control circuit 22 outputs a signal to turn on the switch element Q1. Based on the output signal from the control circuit 22, the drive circuit 3 of the switch element Q1 increases the gate voltage of the switch element Q1, thereby turning on the switch element Q1.

The energy accumulated in the reactor L1 has been consumed, and therefore, the ON current passing through the reactor L1, switch element Q1, and current detection resistor R1 gradually increases from zero. Due to this, the voltage (R1 generated voltage) across the current detection resistor R1 gradually increases from zero.

At time t8, the voltage (R1 generated voltage) generated by the current detection resistor R1 exceeds the reference voltage Vref and the switch element Q1 again turns off. Similar to the case at time t4, the energy of the counter electromotive force accumulated in the reactor L1 breaks down the switch element Q1 that is OFF and passes a current. While the voltage generated by the resistor R1 is being higher than the reference voltage Vx (until time t10), the comparator C1 maintains the low-level output.

The output voltage from the delay circuit 41 becomes low at time t9 when the predetermined time Tx elapses after time t8 at which the first control signal (constant current circuit output voltage) becomes low. Accordingly, at time t9, the output from the delay circuit 41, i.e., delay circuit output voltage becomes low. At this time, the output from the comparator C1 (C1 output voltage) is also low. As a result, the NOR gate 43 outputs a high-level pulse signal.

The counter circuit 45 counts the number of pulse signals from the NOR gate 43. At time t9, the counter circuit 45 receives the second pulse signal, and therefore, counts "2".

Repeating this, and at time t13, the counter circuit 45 receives the Nth pulse signal and outputs a pulse signal to the SR latch circuit 44.

Based on the high-level signal outputted from the counter circuit 45, the SR latch circuit 44 determines that a disconnection has occurred and outputs a high-level latch signal as the second control signal to the drive circuit 3 of the switch element Q1. Based on the second control signal generated by the disconnection detection circuit 4*b*, the drive circuit 3 of the switch element Q1 keeps the switch element Q1 OFF in priority to the first control signal.

The remaining operation is the same as that of the LED drive circuit according to Embodiment 1 illustrated in FIG. 6, and therefore, overlapping explanation is omitted.

In this way, the LED drive circuit according to Embodiment 2 of the present invention provides the effect of Embodiment 1, and in addition, keeps the switch element Q1 OFF only when determining a disconnection upon detecting a predetermined number of times or over of occurrence of a state that a drain current equal to or over a predetermined value is passing to the switch element Q1 when the predetermined time Tx elapses after the timing at which the switch element Q1 changes its state from ON to OFF. This increases the reliability of disconnection detection and realizes stable operation.

Figure 15:
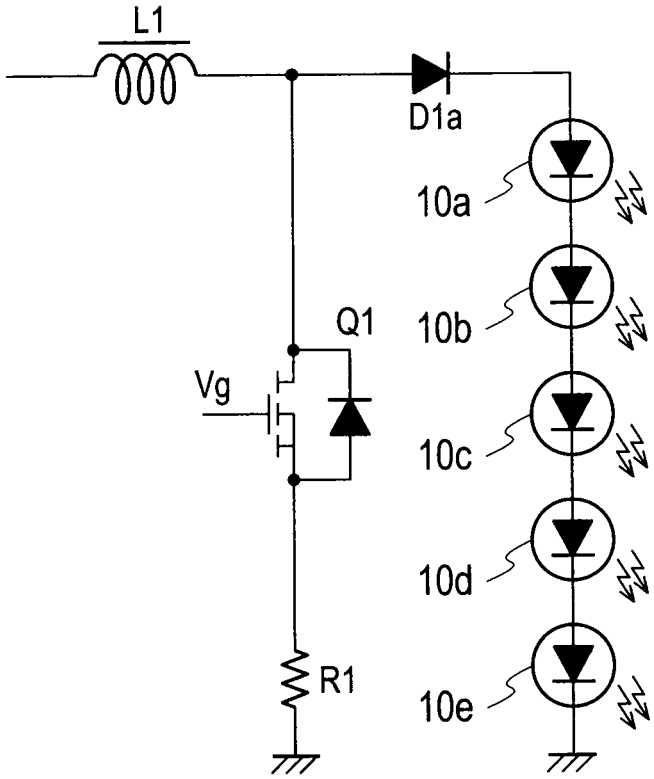
FIG. 15 is a circuit diagram illustrating the configuration of an LED drive circuit employing a step-up converter.

FIG. 15 is a circuit diagram illustrating the configuration of an LED drive circuit employing a step-up converter. The LED drive circuits according to Embodiments 1 and 2 of the present invention are effective for the step-up converter illustrated in FIG. 15. Namely, the constant current circuit 2, drive circuit 3 of the switch element Q1, and disconnection detection circuit 4*a* or 4*b* are applicable to the LED drive circuit employing the step-up converter. Then, even if a disconnection occurs in a rectifying diode D1*a* or LEDs 10*a* to 10*e* so that energy accumulated in a reactor L1 is consumed by a switch element Q1, it is possible to detect the disconnection, stop the switching operation of the switch element Q1, and prevent the switch element Q1 from being broken down.

Embodiment 3

Figure 16:
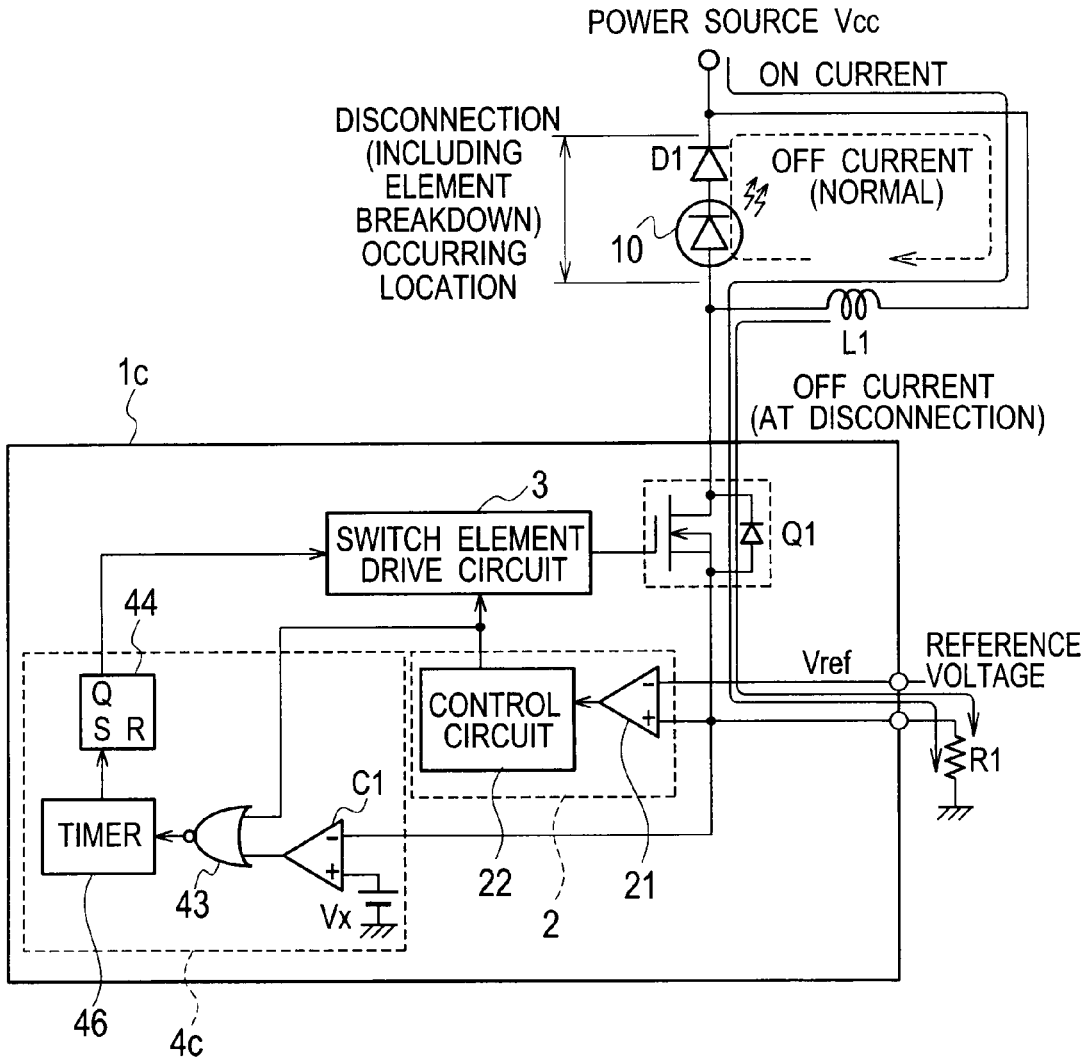
FIG. 16 is a circuit diagram illustrating the configuration of an LED drive circuit according to Embodiment 3 of the present invention.

FIG. 16 is a circuit diagram illustrating the configuration of an LED drive circuit according to Embodiment 3 of the present invention. What is different from the LED drive circuit according to Embodiment 2 illustrated in FIG. 13 is that a timer circuit 46 is arranged in place of the counter circuit 45.

A comparator C1 compares a voltage generated by a current detection resistor R1 with a predetermined reference voltage Vx and outputs a comparison result.

A NOR gate 43 outputs a high-level signal to the timer circuit 46 only when a first control signal generated by a constant current circuit 2 and the output from the comparator C1 each are of low level. In other cases, the NOR gate 43 outputs a low-level signal.

If the signal outputted from the NOR gate 43 keeps high level for a predetermined time Ta or over, the timer circuit 46 generates and outputs a high-level disconnection detected signal. The state that the NOR gate 43 is outputting the high-level signal means that, as mentioned above, a predetermined drain current is passing to the switch element Q1 although the switch element Q1 is OFF. Namely, based on the first control signal generated by the constant current circuit 2 and the comparison result from the comparator C1, the timer circuit 46 outputs the disconnection detected signal if the state that infers the occurrence of a disconnection continues for the predetermined time Ta or over.

An SR latch circuit 44 corresponds to the latch circuit of the present invention, generates a latch signal if receiving the disconnection detected signal from the timer circuit 46, and outputs the signal as a second control signal. In more detail, the SR latch circuit 44 outputs the latch signal when receiving a pulse signal from the timer circuit 46.

The remaining configuration of the LED drive circuit according to Embodiment 3 is the same as that of the LED drive circuit according to Embodiment 2 illustrated in FIG. 13, and therefore, overlapping explanation is omitted.

Figure 17:
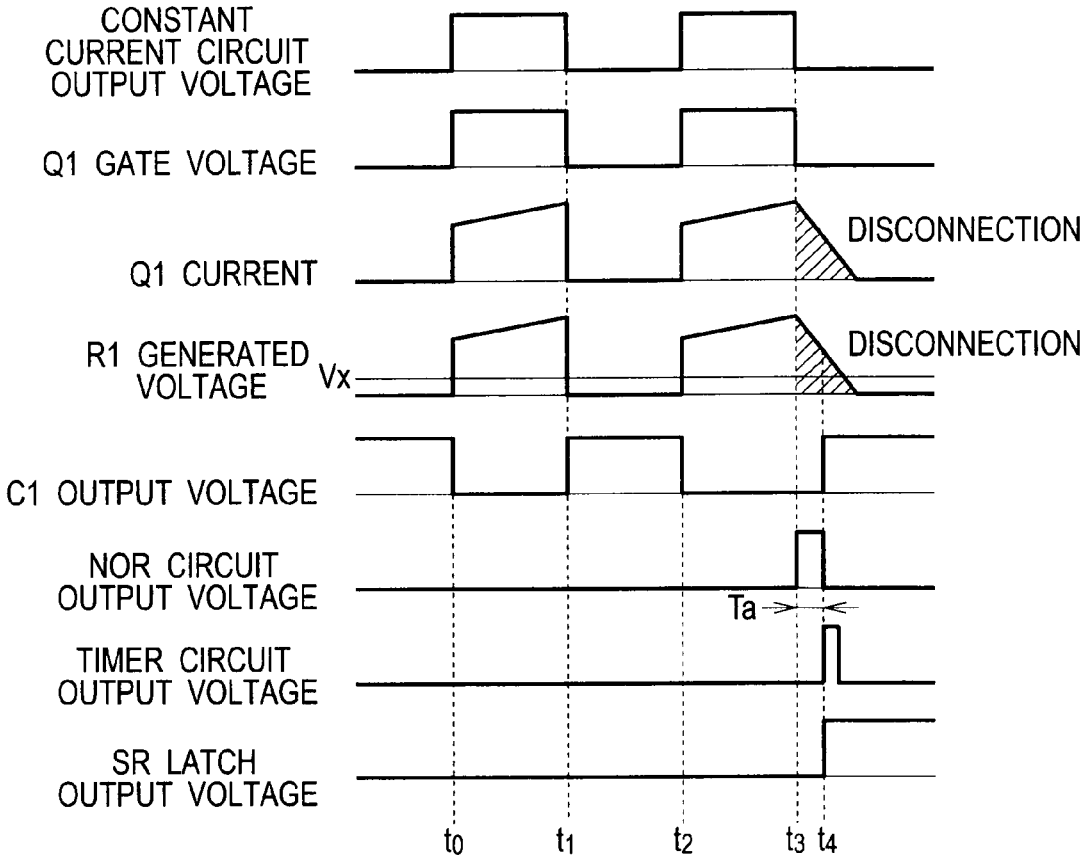
FIG. 17 is a view illustrating operating waveforms at various locations in the LED drive circuit according to Embodiment 3 of the present invention.

Operation of the embodiment with the above-mentioned configuration will be explained. Operation of the LED drive circuit according to the embodiment is substantially the same as that of the LED drive circuit according to Embodiment 1 except that of the timer circuit 46. FIG. 17 is a view illustrating operating waveforms at various locations in the LED drive circuit according to the embodiment. First, the switch element Q1 turns on at time t0 of FIG. 17 when a drive circuit 3 of the switch element Q1 applies a predetermined gate voltage. At this time, an ON current (load current) passes through a path extending along a power source, a reactor L1, the switch element Q1, and the current detection resistor R1 to the ground, thereby accumulating energy of counter electromotive force in the reactor L1.

Between time t0 and t1 of FIG. 17, the ON current (Q1 current, load current) increases at a predetermined inclination according to a constant of the reactor L1. The ON current passes through the current detection resistor R1, and therefore, a voltage (R1 generated voltage) generated by the current detection resistor R1 similarly increases.

At time t1, the voltage (R1 generated voltage) generated by the current detection resistor R1 exceeds a reference voltage Vref, and therefore, an output from the comparator 21 inverts. Then, the control circuit 22 outputs the first control signal to turn off the switch element Q1. This first control signal is the constant current circuit output voltage illustrated in FIG. 17, and at time t1, becomes low to turn off the switch element Q1.

According to the first control signal generated by the constant current circuit 2, the drive circuit 3 drives the switch element Q1. Namely, according to the first control signal (constant current circuit output voltage) from the control circuit 22, the drive circuit 3 of the switch element Q1 decreases the gate voltage of the switch element Q1, thereby turning off the switch element Q1.

With this, the energy of counter electromotive force accumulated in the reactor L1 passes a regenerative current through a loop including the reactor L1, LED 10, and diode D1 and is thereby consumed. Accordingly, no current passes through the current detection resistor R1 and the voltage (R1 generated voltage) across the current detection resistor R1 becomes zero.

Between time t1 and t2, the first control signal (constant current circuit output voltage) is low and an output (C1 output voltage) from the comparator C1 is high, and therefore, the NOR gate 43 maintains a low-level output.

At time t2 when a predetermined time elapses after time t1, the control circuit 22 outputs the first control signal of high level to turn on the switch element Q1. Based on the first control signal from the control circuit 22, the drive circuit 3 of the switch element Q1 increases the gate voltage of the switch element Q1, thereby turning on the switch element Q1.

Operation between time t2 and t3 is the same as that between time t0 and t1 mentioned above, and therefore, overlapping explanation is omitted. It is supposed that a disconnection occurs between time t2 and t3.

At time t3, the voltage (R1 generated voltage) generated by the current detection resistor R1 exceeds the reference voltage Vref and the output from the comparator 21 inverts. Then, the control circuit 22 outputs the first control signal to turn off the switch element Q1. Based on the output signal from the control circuit 22, the drive circuit 3 of the switch element Q1 decreases the gate voltage of the switch element Q1, thereby turning off the switch element Q1.

However, there is the disconnection. The energy of the counter electromotive force accumulated in the reactor L1, therefore, is unable to pass as a regenerative current through the LED 10 side. Then, the energy of the counter electromotive force accumulated in the reactor L1 breaks down the switch element Q1 that is OFF and passes a current. Namely, the switch element Q1 breaks down with a withstand voltage specific to the switch element Q1, and with the specific voltage being maintained, a drain current (reactor current) continuously passes. This current also passes through the current detection resistor R1, to cause a positive potential difference at the current detection resistor R1. Accordingly, while the voltage generated by the resistor R1 is being higher than the reference voltage Vx, the comparator C1 maintains the low-level output.

The first control signal (constant current circuit output voltage) becomes low at time t3. Namely, at time t3, the first control signal is low and the output (C1 output voltage) from the comparator C1 is also low. Accordingly, the NOR gate 43 outputs a high-level signal.

If the signal outputted from the NOR gate 43 maintains the high level for the predetermined time Ta or over, the timer circuit 46 generates and outputs a high-level disconnection detected signal. The timer circuit 46 starts to measure time from time t3 when the NOR gate 43 outputs the high-level signal, and at the same time, monitors the output signal from the NOR gate 43. The output signal from the NOR gate 43 maintains the high level for the predetermined time Ta, and at time t4, the timer circuit 46 determines that a state that infers the occurrence of a disconnection has continued for the predetermined time Ta or over and outputs a disconnection detected signal to the SR latch circuit 44.

Based on the high-level disconnection detected signal from the timer circuit 46, the SR latch circuit 44 outputs a high-level latch signal as the second control signal to the drive circuit 3 of the switch element Q1. Based on the second control signal generated by the disconnection detection circuit 4*c*, the drive circuit 3 of the switch element Q1 maintains the OFF state of the switch element Q1 at the occurrence of disconnection in priority to the first control signal.

The remaining operation is the same as that of the LED drive circuit according to Embodiment 1 illustrated in FIG. 6, and therefore, overlapping explanation is omitted.

As mentioned above, the LED drive circuit according to Embodiment 3 of the present invention employs the timer circuit 46, to determine the occurrence of an element breakdown of, for example, the LED 10 or a disconnection only when the output signal from the NOR gate 43 maintains a high level for a predetermined time (Ta). Unlike the LED drive circuit according to Embodiment 1 that employs the delay circuit 41, the LED drive circuit according to Embodiment 3 is capable of correctly detecting a disconnection without using the delay circuit 41 and without the influence of chattering.

Effect of Invention

The present invention provides the LED drive circuit that prevents a switch element from being destroyed even when a breakdown of an element such as an LED or a disconnection occurs.

INDUSTRIAL APPLICABILITY

The LED drive circuit according to the present invention is applicable as an LED drive circuit for driving LEDs used for, for example, LED illumination.

United States Designation

In connection with United States designation, this international patent application claims the benefit of priority under 35 U.S.C. 119(a) to Japanese Patent Application No. 2009-189147 filed on Aug. 18, 2009 whose disclosed contents are cited herein.

The invention claimed is:

1. An LED drive circuit for driving an LED comprising:

a reactor accumulating power energy to supply a current to the LED;

a switch element configured to pass a current through the reactor as being ON and to supply energy accumulated in the reactor to the LED as being OFF;

a current detector detecting a current passing through the switch element;

a constant current circuit configured to generate a first control signal to control a current passing through the switch element to be constant based on a current value detected by the current detector;

a disconnection detector configured to generate a second control signal to keep the switch element OFF if determined that a current equal to or over a predetermined value passes through the switch element when a predetermined time elapses after the timing at which the switch element changes its state from ON to OFF, according to a current detected by the current detector and the first control signal generated by the constant current circuit; and a driver of the switch element configured to drive the switch element according to the first control signal generated by the constant current circuit and keeps the switch element OFF in case of a disconnection according to the second control signal generated by the disconnection detector in priority to the first control signal, wherein the current detector is a resistor that is connected in series with the switch element and generates a voltage corresponding to a current passing through the switch element, wherein the disconnection detector includes:

a delay circuit configured to provide the first control signal generated by the constant current circuit with a predetermined delay and outputs the delayed signal;

a comparator comparing the voltage generated by the resistor with a predetermined reference voltage and outputs a comparison result; and a latch circuit configured to generate a latch signal if determining that a disconnection has occurred and outputs the latch signal as the second control signal, according to the output from the delay circuit and the output from the comparator.

2. The LED drive circuit as set forth in claim 1, wherein:

the disconnection detector includes a counter circuit that counts, according to the output from the delay circuit and the output from the comparator, the number of times of occurrence of a state that a current equal to or over the predetermined value is passing to the switch element when a predetermined time elapses after the timing at which the switch element changes its state from ON to OFF; and the latch circuit determines that a disconnection has occurred if the number of times counted by the counter circuit reaches a predetermined value or over and generates the latch signal.

3. An LED drive circuit for driving an LED comprising:

a reactor accumulating power energy to supply a current to the LED;

a switch element configured to pass a current through the reactor as being ON and to supply energy accumulated in the reactor to the LED as being OFF;

a current detector detecting a current passing through the switch element;

a constant current circuit configured to generate a first control signal to control a current passing through the switch element to be constant based on a current value detected by the current detector;

a disconnection detector configured to generate a second control signal to keep the switch element OFF if determined that a current equal to or over a predetermined value passes through the switch element when a predetermined time elapses after the timing at which the switch element changes its state from ON to OFF, according to a current detected by the current detector and the first control signal generated by the constant current circuit; and a driver of the switch element configured to drive the switch element according to the first control signal generated by the constant current circuit and keeps the switch element OFF in case of a disconnection according to the second control signal generated by the disconnection detector in priority to the first control signal, wherein the current detector is a resistor that is connected in series with the switch element and generates a voltage corresponding to a current passing through the switch element, wherein the disconnection detector includes:

a comparator comparing the voltage generated by the resistor with a predetermined reference voltage and outputs a comparison result;

a timer circuit configured to output a disconnection detected signal according to the first control signal generated by the constant current circuit and the comparison result output from the comparator if a state that infers the occurrence of a disconnection continues for a predetermined time or over; and a latch circuit configure to generate a latch signal if receiving the disconnection detected signal from the timer circuit and output the latch signal as the second control signal.

* * * * *